US010421084B2

(12) United States Patent
Lin et al.

(10) Patent No.: US 10,421,084 B2
(45) Date of Patent: Sep. 24, 2019

(54) OUTLET DEVICE AND SHOWER HEAD WITH SLOW VORTEX ROTATING WATER

(71) Applicant: XIAMEN SOLEX HIGH-TECH INDUSTRIES CO., LTD., Xiamen, Fujian (CN)

(72) Inventors: Fengde Lin, Fujian (CN); Shigang Wang, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 27 days.

(21) Appl. No.: 15/388,788

(22) Filed: Dec. 22, 2016

(65) Prior Publication Data

US 2017/0252758 A1 Sep. 7, 2017

(30) Foreign Application Priority Data

Mar. 4, 2016 (CN) ..... 2016 1 0122475

(51) Int. Cl.

| | |
|---|---|
| ***B05B 1/34*** | (2006.01) |
| ***B05B 1/18*** | (2006.01) |
| ***B05B 1/04*** | (2006.01) |

(52) U.S. Cl.

CPC ..... *B05B 1/3442* (2013.01); *B05B 1/048* (2013.01); *B05B 1/185* (2013.01); *B05B 1/3478* (2013.01)

(58) Field of Classification Search

CPC ..... B05B 1/3442; B05B 1/185; B05B 1/048; B05B 1/3478; B05B 1/08; B05B 1/34; B05B 17/04; B60S 1/52

USPC ..... 239/472, 589.1

See application file for complete search history.

(56) References Cited

U.S. PATENT DOCUMENTS

| | | | | |
|---|---|---|---|---|
| 1,601,724 A * | 10/1926 | Ellis | B05B 1/3442 | 239/488 |
| 2,428,748 A * | 10/1947 | Barz | B05B 1/3436 | 239/472 |
| 5,740,967 A * | 4/1998 | Simmons | B05B 1/3436 | 239/494 |
| 8,490,895 B2 * | 7/2013 | Jaworski | B05B 1/3421 | 239/209 |

(Continued)

*Primary Examiner* — Alexander M Valvis
*Assistant Examiner* — Qingzhang Zhou
(74) *Attorney, Agent, or Firm* — Rabin & Berdo, P.C.

(57) ABSTRACT

An outlet device provides vortex rotating water and includes a diverter having a side surface disposed with at least two spiral accelerating grooves extending along an axial direction and having a bottom surface disposed with a collision chamber, the at least two spiral accelerating grooves being evenly arranged about an axis of the collision chamber and having respective ends that connect to the side walls of the collision chamber; and an outlet body disposed with an accommodating chamber and a vortex rotating chamber connected to each other in the axial direction. The diverter is disposed in the accommodating chamber. The vortex rotating chamber is a dome shaped body having a flat end face that is connected to a bottom end of the accommodating chamber and has an external protruding surface. The outlet body has an outlet connected to the external protruding surface of the vortex rotating chamber.

10 Claims, 18 Drawing Sheets

(56) References Cited

U.S. PATENT DOCUMENTS

2012/0266376 A1* 10/2012 Marty ..... B05B 1/185
4/615

* cited by examiner

OUTLET DEVICE AND SHOWER HEAD WITH SLOW VORTEX ROTATING WATER

FIELD OF THE INVENTION

The present invention relates to an outlet device, particularly to a shower device.

BACKGROUND OF THE INVENTION

There are various of shower heads and outlet functions. Shower heads are developed to multi-functional shower heads with massage function from single function. The massage function of the shower head is achieved by water particles impacting the human body. But existing shower heads in the recent market is complicated in structure to achieve the water particle outlet, the cover area is not large enough, so the shower effect is less than satisfactory; moreover, it needs high flow volume to achieve the water particle outlet, which is not in accordance with the environmental friendly and water saving.

SUMMARY OF THE INVENTION

The present invention is provided with an outlet device, which can achieve spraying rotating particle water in a low flow volume by slow vortex.

The present invention is further provided with a shower head, which can achieve outlet water particles rotating in a low flow volume by slow vortex.

The technical solution of the present invention is that:

An outlet device with slow vortex rotating water, wherein comprising a diverter and an outlet body;

the side surface of the diverter is disposed with at least two spiral accelerating grooves extending along the axial; the bottom surface of the diverter is disposed with a column shaped collision chamber concaved in the axial direction; the spiral accelerating grooves are evenly arranged about the axes of the collision chamber at the side surface of the diverter, the end of the spiral accelerating groove extends to the bottom surface of the diverter to connect to the side wall of the collision chamber;

the outlet body is disposed with an accommodating chamber and a vortex rotating chamber connected to each other in the axial direction; the diverter is disposed in the accommodating chamber; the vortex rotating chamber is a ball-crown body, the flat end face is connected to the bottom end of the accommodating chamber; the end of the outlet body is disposed with an outlet connected to the top end of the external protruding surface of the vortex rotating chamber.

In another preferred embodiment, the helix angle θ of the spiral accelerating groove meets the requirement that $71° \leq \theta \leq 81°$; the axes of the collision chamber of the diverter is disposed with a through hole connected to the top surface of the diverter.

In another preferred embodiment, the end of the at least two spiral accelerating groove are rotatably symmetrically arranged about the axes of the collision chamber. In another preferred embodiment, the section of the outlet is circular, oval, rounded rectangle, cross or tri-forked formed by three rounded rectangles with one ends connected and the other ends intersected in 120°.

The present invention is further provided with a shower head with slow vortex rotating water, wherein comprising a main body, a cover plate, a diverter and an outlet body;

the cover plate is disposed with a plurality of through grooves in the axial direction to assemble the outlet body;

the side surface of the diverter is disposed with at least two spiral accelerating grooves extending along the axial; the bottom surface of the diverter is disposed with a column shaped collision chamber concaved in the axial direction; the spiral accelerating grooves are evenly arranged about the axes of the collision chamber at the side surface of the diverter, the end of the spiral accelerating groove extends to the bottom surface of the diverter to connect to the side wall of the collision chamber;

the outlet body is disposed with an accommodating chamber and a vortex rotating chamber connected to each other in the axial direction; the diverter is disposed in the accommodating chamber; the vortex rotating chamber is a ball-crown body, the flat end face is connected to the bottom end of the accommodating chamber; the end of the outlet body is disposed with an outlet connected to the top end of the external protruding surface of the vortex rotating chamber.

In another preferred embodiment, the helix angle θ of the spiral accelerating groove meets the requirement that $71° \leq \theta \leq 81°$; the axes of the collision chamber of the diverter is disposed with a through hole connected to the top surface of the diverter. In another preferred embodiment, the end of the at least two spiral accelerating groove are rotatably symmetrically arranged about the axes of the collision chamber. In another preferred embodiment, the section of the outlet is circular, oval, rounded rectangle, cross or tri-forked formed by three rounded rectangles with one ends connected and the other ends intersected in 120°.

In another preferred embodiment, the external side wall of the accommodating chamber of the outlet body is disposed with two protruding blocks vertical to the side wall of the accommodating chamber.

In another preferred embodiment, the intersection angle of the two protruding blocks is 180°; the internal side wall of the through groove is disposed with four grooves coupled to the protruding blocks; the intersection angle of the grooves is 90°.

Compared to the traditional technology, the technical solution of the present invention has following advantages:

1. The outlet device with slow vortex rotating water of the present invention is provided that: water flows out of the two spiral accelerating grooves of the diverter with one portion impacting in the collision chamber and the other portion flowing to the vortex rotating chamber eccentrically along the inner wall of the vortex rotating chamber. As the water has a portion flowing to the vortex rotating chamber, the flowing rate is reduced, a slow vortex rotating water is formed in the vortex rotating chamber, water is then rectified in the outlet and then flows out.

2. The outlet device with slow vortex rotating water of the present invention is provided that: the section of the outlet is rounded rectangle. When the slow vortex rotating water flows through the rounded rectangle outlet, in the long shaft direction, it flows out along the tangent line of the intersection surface of the vortex rotating chamber and the rounded rectangle outlet and forms with a certain of flare angle due to inertia; in the short shaft direction, as the tangent line the intersection surface of the vortex rotating chamber and the rounded rectangle outlet is nearly horizontal, the water only impacts. As water flows out of the outlet in slow vortex state, the outlet water type is not traditional fan-shaped, but fan-shaped water particles with rotating angle, similar to wavy shape.

3. The outlet device with slow vortex rotating water of the present invention is provided that: the section of the outlet is circular or oval. The slow vortex rotating water flows out of the circular or oval outlet forms a circular or oval hollow water sheet at the front end of the outlet as the eccentric force of the rotating water is larger than the surface tension of water. When the rotating water flows away from the outlet gradually, the eccentric force is reduced; when the eccentric force is smaller than the surface tension, the rotating water retracts again and impacts to form water particles.

4. The outlet device with slow vortex rotating water of the present invention is provided that: the section of the outlet is tri-forked formed by three rounded rectangles with one ends connected and the other ends intersected in 120°. For any half rounded rectangle outlet, the rotating water flows out of the tangent line of the vortex rotating chamber and the half rounded rectangle outlet in the long shaft direction and forms with a half of flare angle due to inertia; in the short shaft direction, as the tangent line of the vortex rotating chamber and the half rounded rectangle outlet is nearly horizontal, the water only impacts; the water flows out with tri-forked shaped with a rotating angle.

DETAILED DESCRIPTION OF THE EMBODIMENTS

Figure 1:
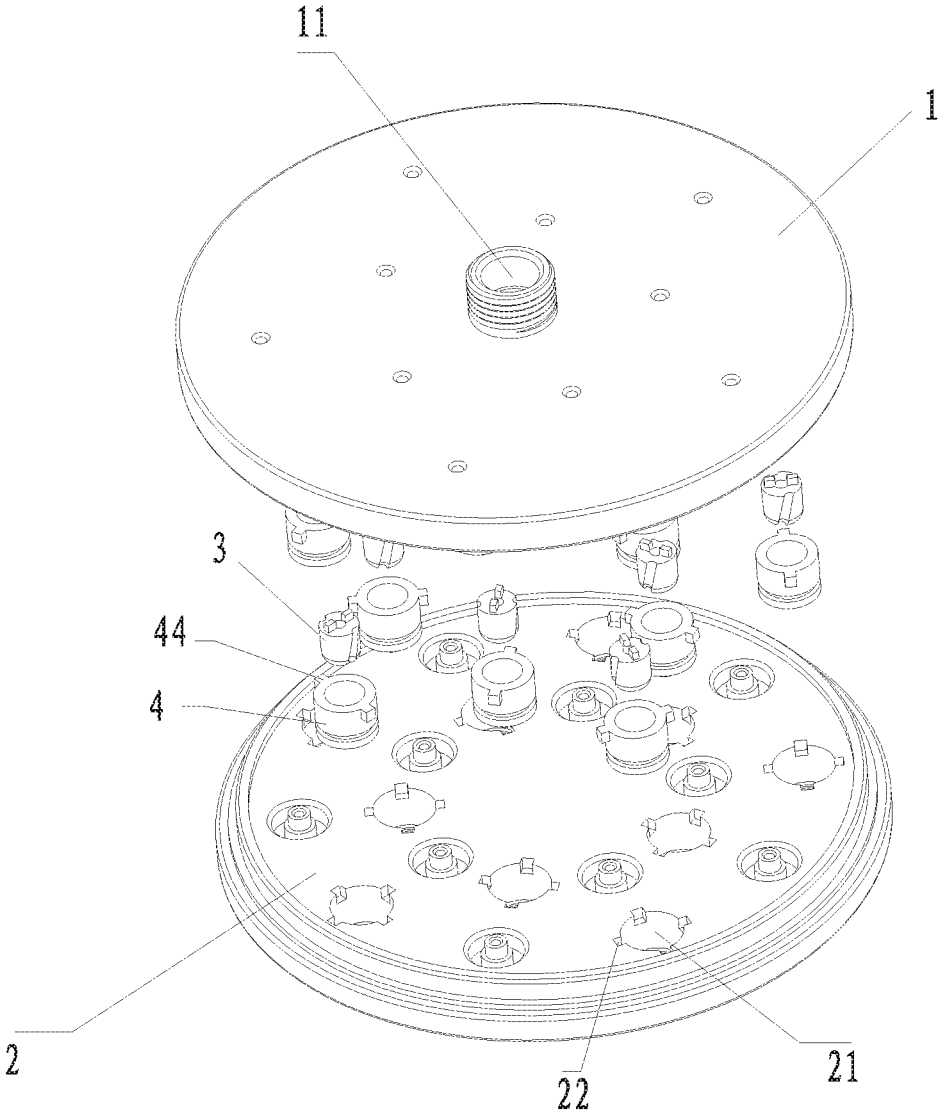
FIG. 1 illustrates an exploded and schematic diagram of a shower head of Embodiment 1 of the present invention.
Figure 2:
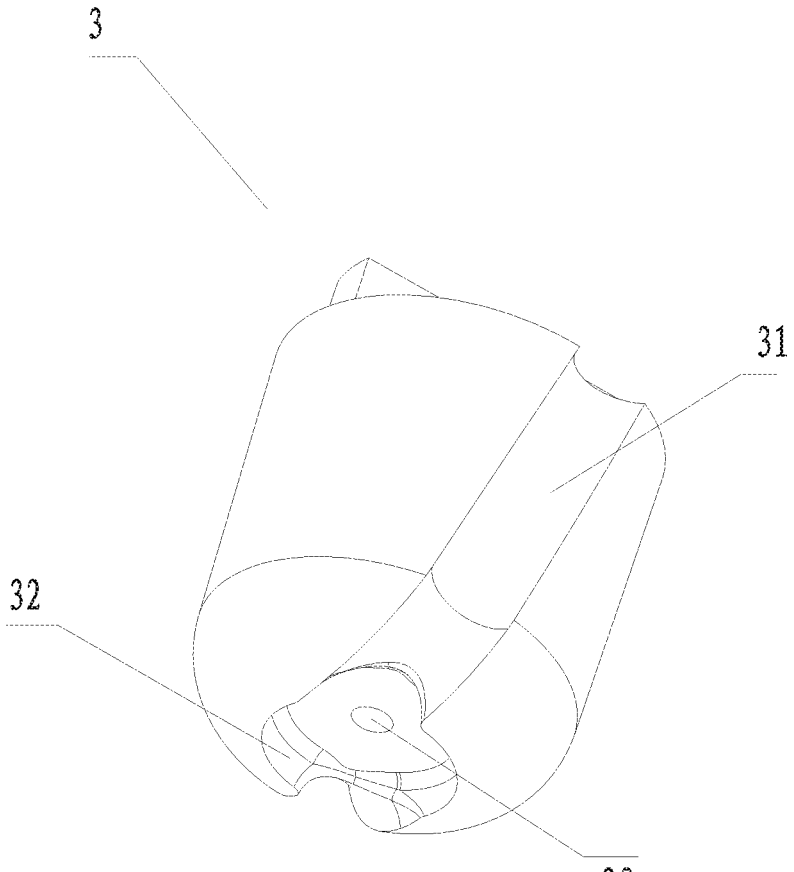
FIG. 2 illustrates a schematic diagram of a diverter of Embodiment 1 of the present invention.
Figure 3:
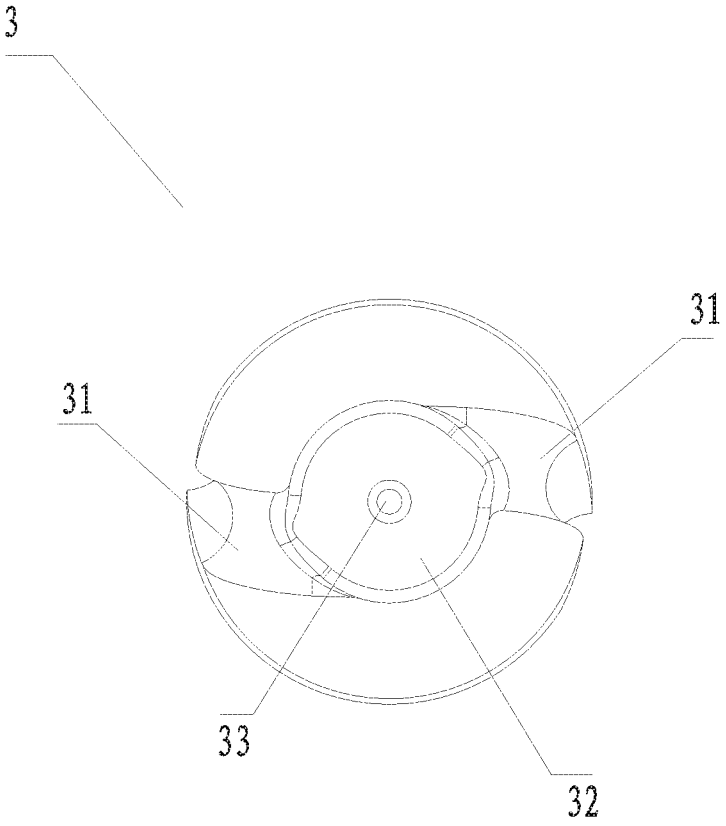
FIG. 3 illustrates a bottom view of the diverter of Embodiment 1 of the present invention.
Figure 4:
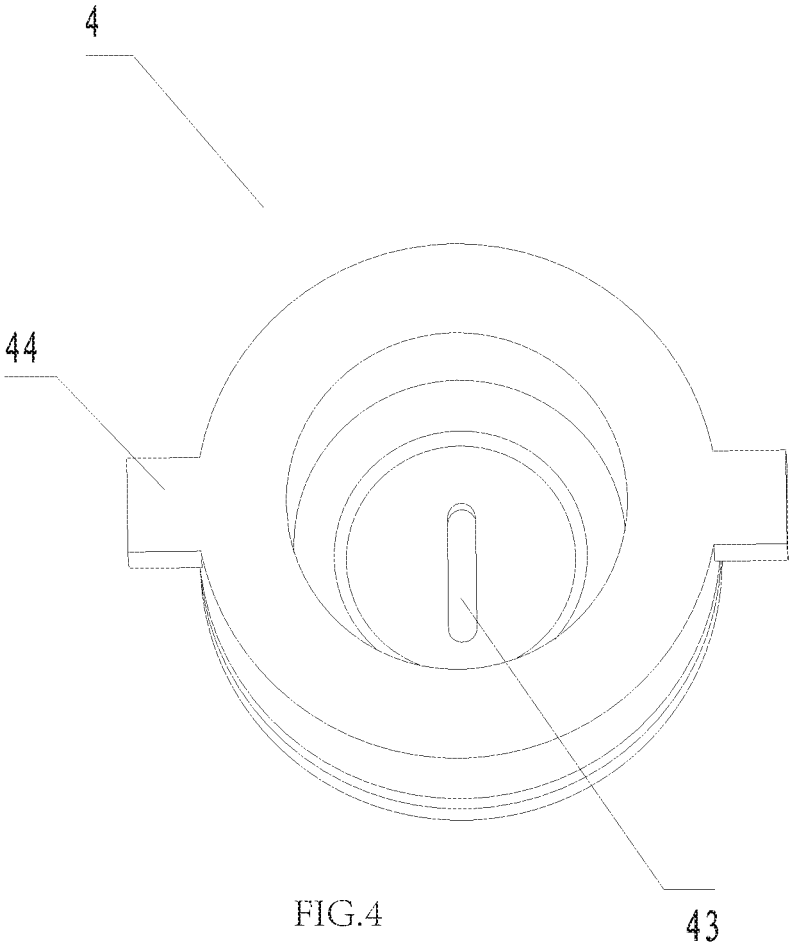
FIG. 4 illustrates a schematic diagram of an outlet body of Embodiment 1 of the present invention.
Figure 5:
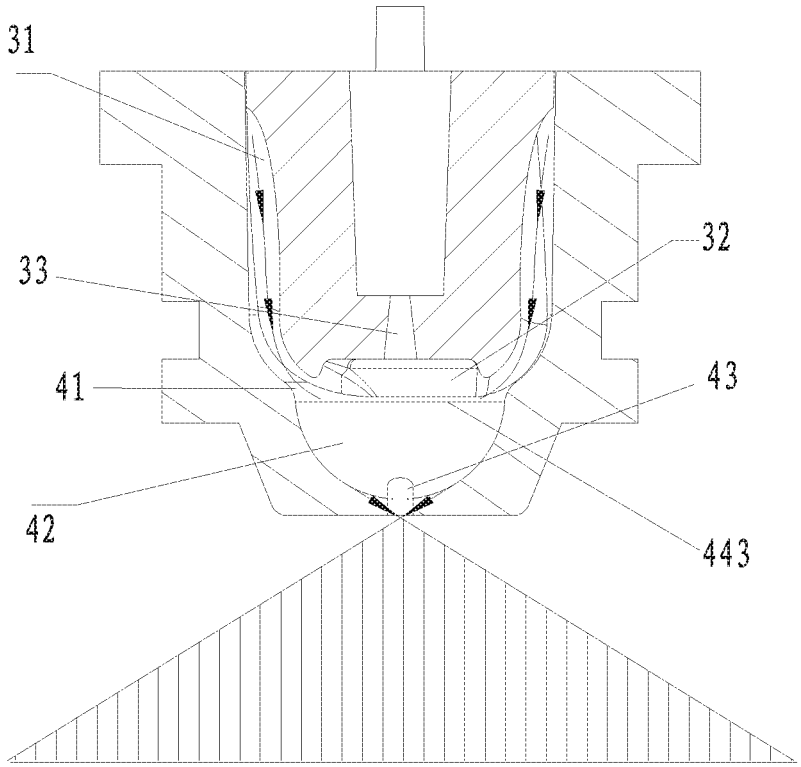
FIG. 5 illustrates a sectional diagram of an outlet device of Embodiment 1 of the present invention in water flowing state.
Figure 6:
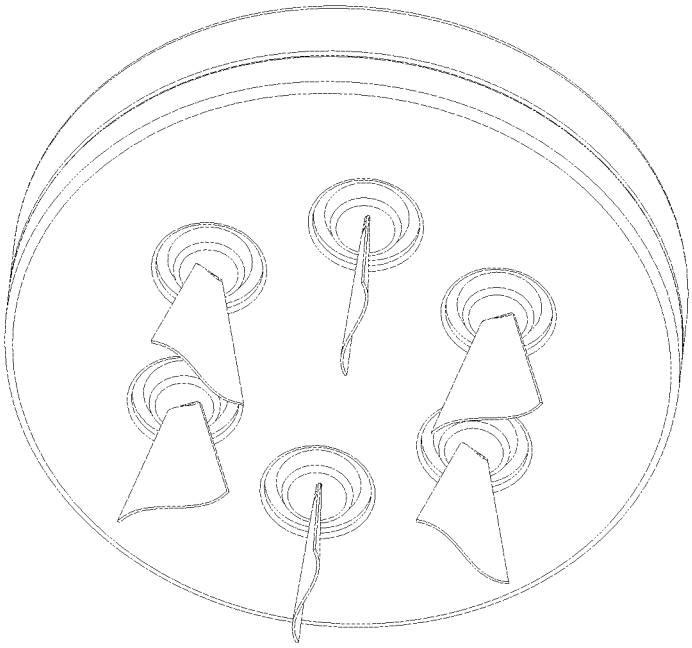
FIG. 6 illustrates a schematic diagram of the shower head of Embodiment 1 of the present invention in water flowing state.

The present invention will be further described with the drawings and embodiments.

Embodiment 1

Referring to FIGS. 1-6, a shower head with slow vortex rotating water comprises a main body 1, a cover plate 2, an outlet device with slow vortex rotating water, the outlet device further comprises a diverter 3 and an outlet body 4;

One side of the main body 1 is disposed with an inlet joint 11, the other side of the main body is assembled to the cover plate 2; the cover plate 2 is disposed with a plurality of through grooves 21 in the axial direction to assemble the outlet body 4; water flows from the inlet joint 11 to the through grooves 21.

The side surface of the diverter 3 is disposed with two spiral accelerating grooves 31 extending along the axial; water speeds up and is provided with a certain rotating speed after flowing through the spiral accelerating grooves 31. In this embodiment, the flowing rate and the rotating speed of water after flowing out of the spiral accelerating grooves 31 should not be too fast, so the helix angle θ of the spiral accelerating groove should be not small, preferred 76° in this embodiment, range of 76°±5° is available only if it can meet the requirement, description would not be provided hereafter.

The bottom surface of the diverter 3 is disposed with a column shaped collision chamber 32 concaved in the axial direction; the spiral accelerating grooves 31 are evenly arranged about the axes of the collision chamber at the side surface of the diverter 32 at the side surface of the diverter 3, the end of the spiral accelerating groove extends to the bottom surface of the diverter 3 to connect to the side wall of the collision chamber 32; the end of the two spiral accelerating groove 31 are rotatably symmetrically arranged about the axes of the collision chamber 32, the symmetrical angle is 180°. The number of the spiral accelerating grooves 31 can be three or more, only to adjust the interval angle of the spiral accelerating grooves, the interval angle of three spiral accelerating grooves is 120°, the interval angle of four spiral accelerating grooves is 90°, and the like.

The outlet body 4 is disposed with an accommodating chamber 41 and a vortex rotating chamber 42 connected to each other in the axial direction; the diverter 3 is disposed in the accommodating chamber 41; the vortex rotating chamber 42 is a ball-crown body (a dome shaped body 42) with a flat end face 443 connected to the bottom end of the accommodating chamber 41; the end of the outlet body 4 is disposed with an outlet 43 connected to the top end of the external protruding surface of the vortex rotating chamber 42.

With above configuration, water flows out of the two spiral accelerating grooves 31 with one portion moving straightly along the horizontal direction to impact in the collision chamber 21 and the other portion flowing to the vortex rotating chamber 42 eccentrically, as water has a certain of rotating speed after flowing out of the spiral accelerating groove 31, and the end of the two spiral accelerating grooves 31 are rotatably symmetrically arranged about the axes of the collision chamber, the flowing direction of water from the two spiral accelerating grooves 31 to the vortex rotating chamber 42 are opposite, forming a continuous rotating water along the inner wall of the ball-crown body. As a portion of water impacts in the collision chamber 32, the flowing rate of the rest portion is reduced, a slow vortex rotating water is formed in the vortex rotating chamber.

In this embodiment, the section of the outlet 43 is rounded rectangle. When the slow vortex rotating water flows through the rounded rectangle outlet 43, in the long shaft direction, it flows out along the tangent line of the intersection surface of the vortex rotating chamber 42 and the rounded rectangle outlet 43 and forms with a certain of flare angle due to inertia; in the short shaft direction, as the tangent line of the intersection surface of the vortex rotating chamber 42 and the rounded rectangle outlet 43 is nearly horizontal, the water only impacts. As water flows out of the outlet in slow vortex state, the outlet water type is not traditional fan-shaped, but fan-shaped water particles with rotating angle, similar to wavy shape.

In this embodiment, the axes of the collision chamber 32 of the diverter 3 is disposed with a through hole 33 connected to the top surface of the diverter. Water flowing out of the through hole 33 impacts the slow vortex rotating water in the vortex rotating chamber 42 again, further reducing the rotating speed of the slow vortex rotating water, thus ensuring the particle density of the outlet water.

The external side wall of the accommodating chamber 41 of the outlet body 4 is disposed with two protruding blocks 44 vertical to the side wall of the accommodating chamber 44, the intersection angle of the two protruding blocks 44 is 180°.

The internal side wall of the through groove 21 is disposed with four grooves 22 coupled to the protruding blocks 44; the intersection angle of the grooves 22 is 90°. The outlet body 4 is inserted to the accommodating chamber 41, so that the protruding blocks 44 are locked to the grooves 22, thus achieving the assembly of the outlet body 4; as there are four grooves 22, the outlet body 4 can be assembled in any direction.

As the shower head of the present invention forms water particles by slow vortex, the outlet effect can be achieved by low flowing volume.

Embodiment 2

Figure 7:
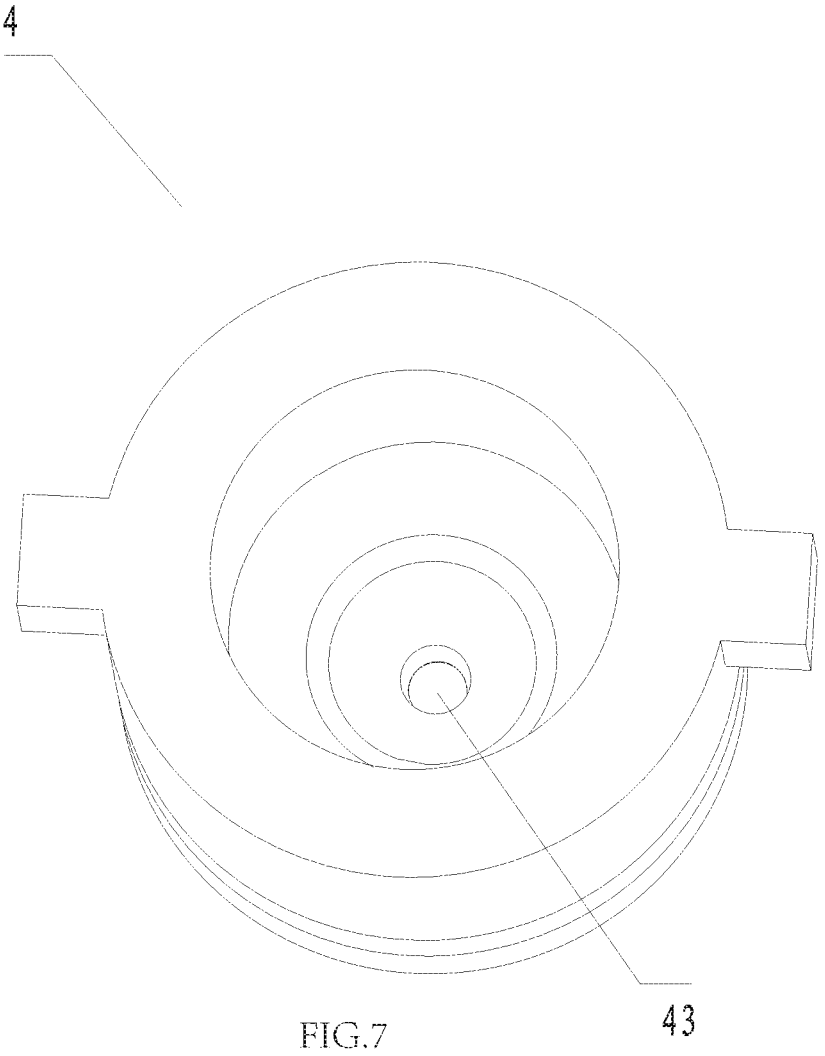
FIG. 7 illustrates a schematic diagram of an outlet body of Embodiment 2 of the present invention.
Figure 8:
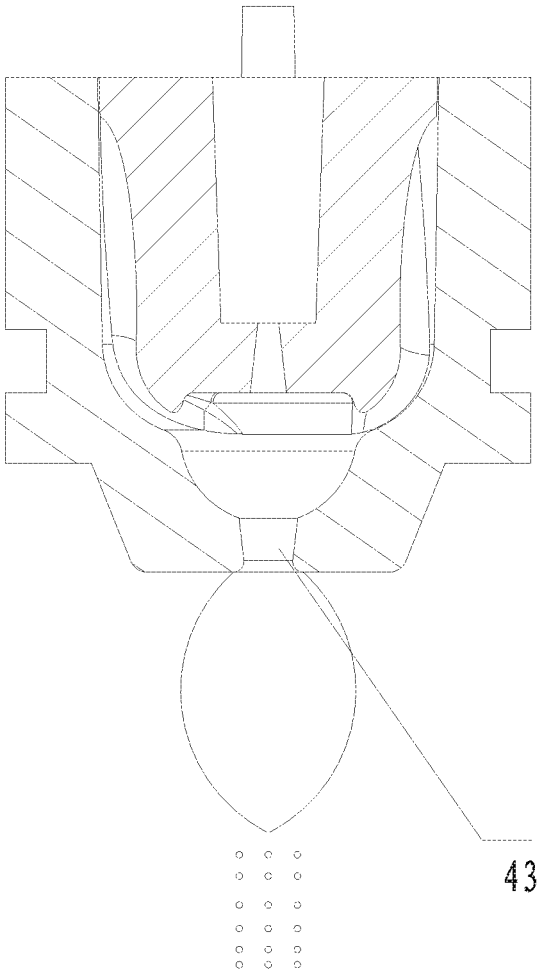
FIG. 8 illustrates a sectional diagram of an outlet device of Embodiment 2 of the present invention in water flowing state.
Figure 9:
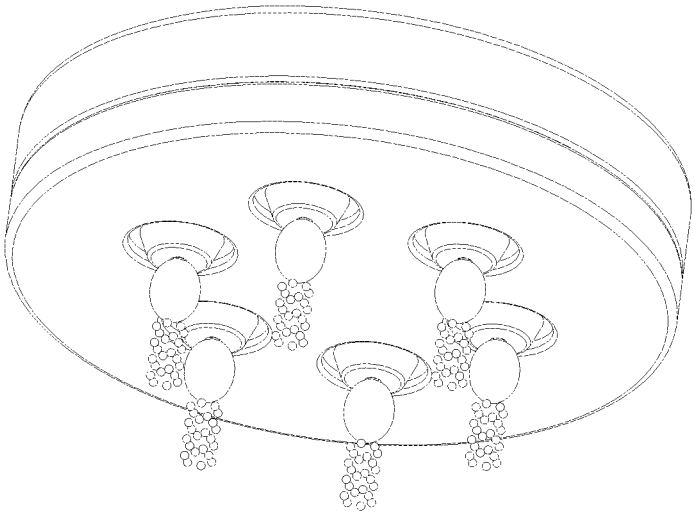
FIG. 9 illustrates a schematic diagram of the shower head of Embodiment 2 of the present invention in water flowing state.

Referring to FIGS. 7-9, this embodiment differs from Embodiment 1 in that: the section of the outlet 43 is circular. The slow vortex rotating water flows out of the circular outlet 43 forms a circular hollow water sheet at the front end of the outlet as the eccentric force of the rotating water is larger than the surface tension of water. When the rotating water flows away from the outlet gradually, the eccentric force is reduced; when the eccentric force is smaller than the surface tension, the rotating water retracts again and impacts to form water particles.

Embodiment 3

Figure 10:
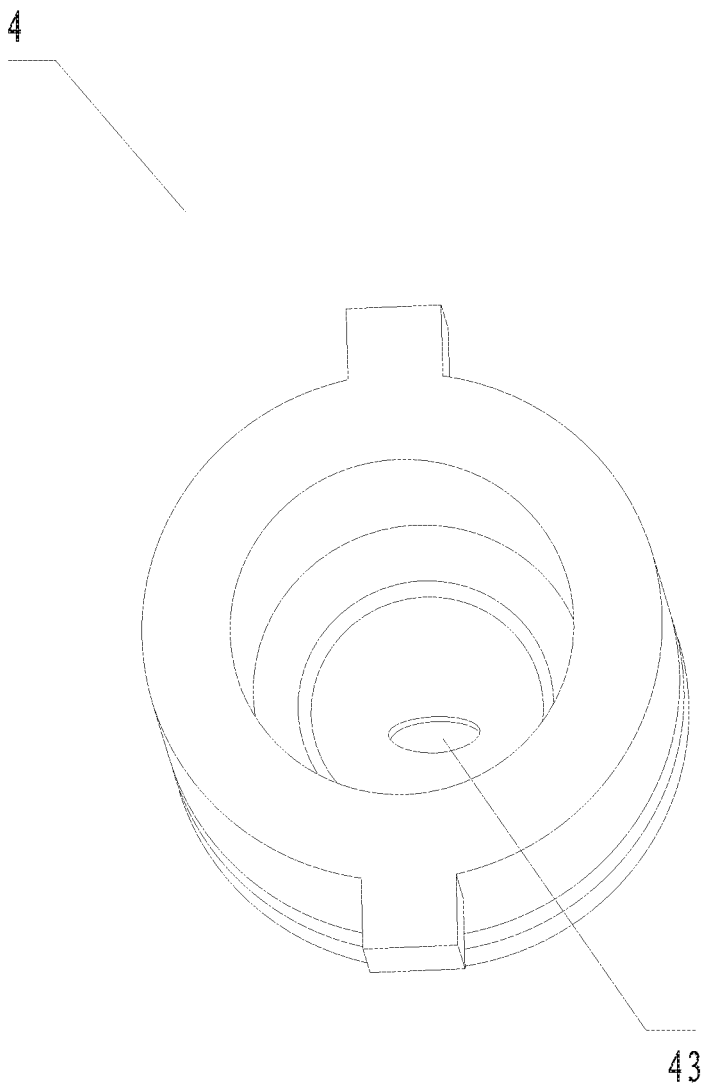
FIG. 10 illustrates a schematic diagram of an outlet body of Embodiment 3 of the present invention.
Figure 11:
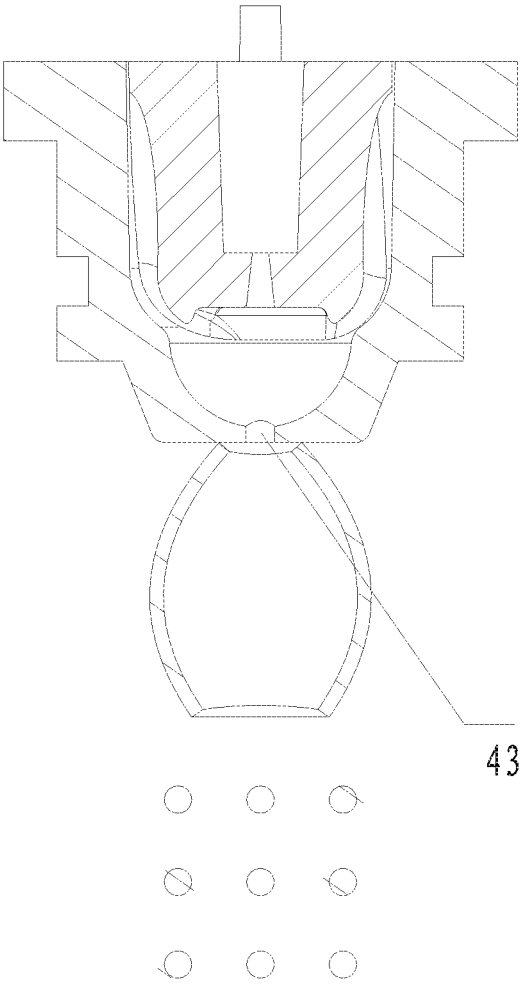
FIG. 11 illustrates a sectional diagram of an outlet device of Embodiment 3 of the present invention in water flowing state.
Figure 12:
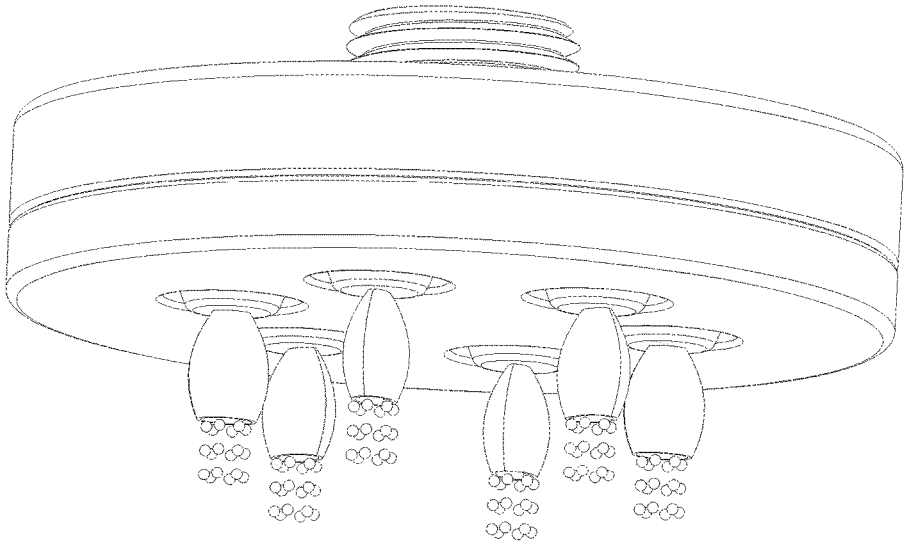
FIG. 12 illustrates a schematic diagram of the shower head of Embodiment 3 of the present invention in water flowing state.

Referring to FIGS. 10-12, this embodiment differs from Embodiment 1 in that: the section of the outlet 43 is oval. The slow vortex rotating water flows out of the oval outlet 43 forms an oval hollow water sheet at the front end of the outlet as the eccentric force of the rotating water is larger than the surface tension of water. When the rotating water flows away from the outlet gradually, the eccentric force is reduced; when the eccentric force is smaller than the surface tension, the rotating water retracts again and impacts to form water particles.

Embodiment 4

Figure 13:
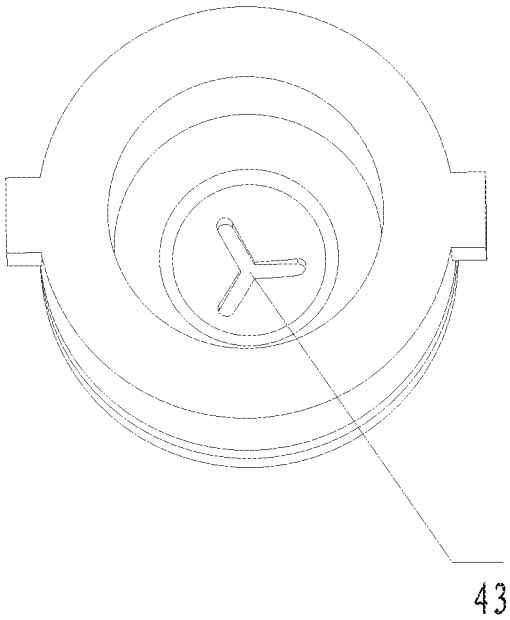
FIG. 13 illustrates a schematic diagram of an outlet body of Embodiment 4 of the present invention.
Figure 14:
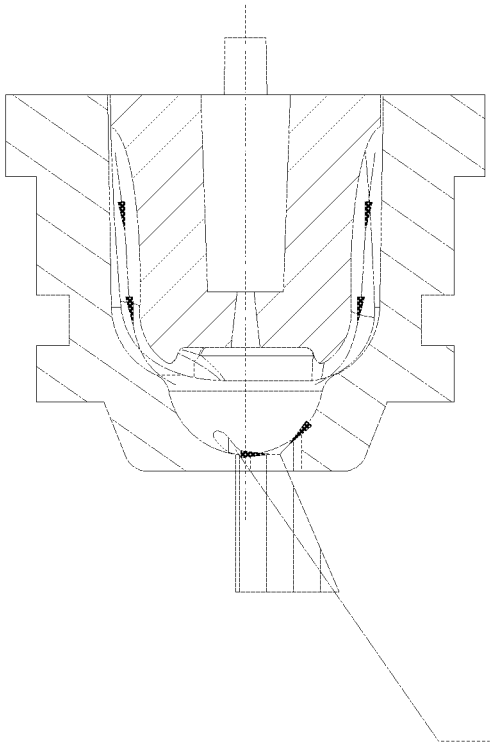
FIG. 14 illustrates a sectional diagram of an outlet device of Embodiment 4 of the present invention in water flowing state.
Figure 15:
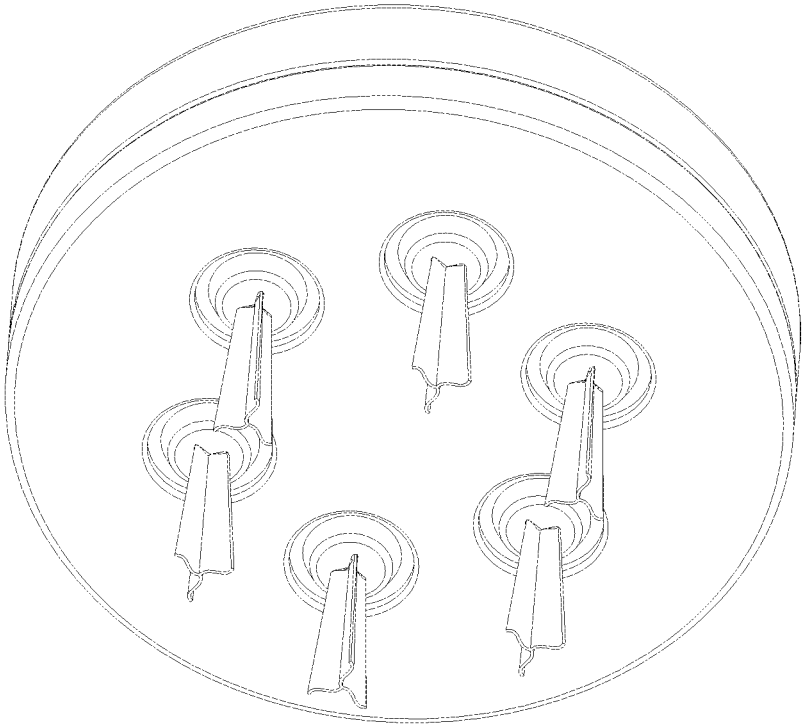
FIG. 15 illustrates a schematic diagram of the shower head of Embodiment 4 of the present invention in water flowing state.

Referring to FIGS. 13-15, this embodiment differs from Embodiment 1 in that: the section of the outlet 43 is tri-forked formed by three rounded rectangles with one ends connected and the other ends intersected in 120°. For any half rounded rectangle outlet 43, the rotating water flows out of the tangent line of the vortex rotating chamber 42 and the half rounded rectangle outlet 43 in the long shaft direction and forms with a half of flare angle due to inertia; in the short shaft direction, as the tangent line of the vortex rotating chamber 42 and the half rounded rectangle outlet 43 is nearly horizontal, the water only impacts; the water flows out with tri-forked shaped with a rotating angle.

Embodiment 5

Figure 16:
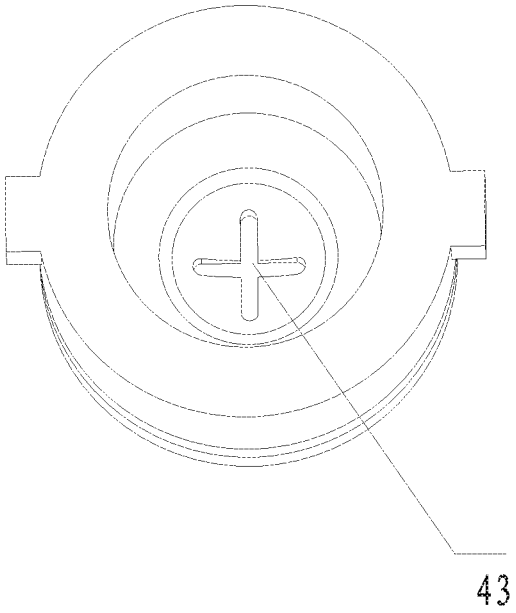
FIG. 16 illustrates a schematic diagram of an outlet body of Embodiment 5 of the present invention.
Figure 17:
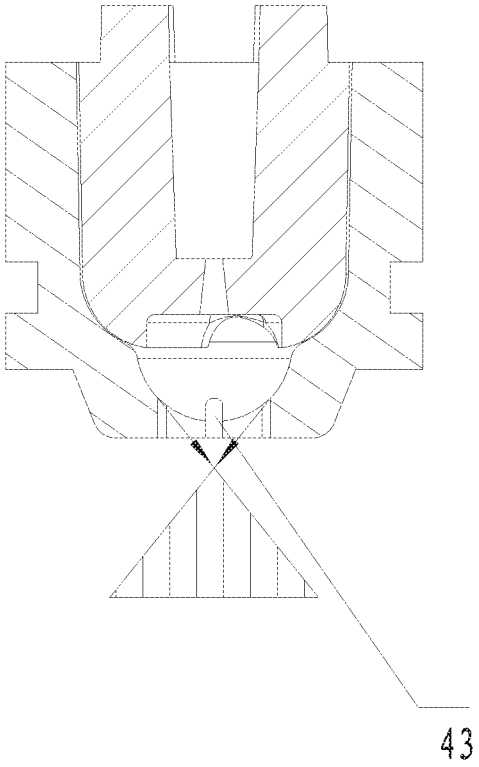
FIG. 17 illustrates a sectional diagram of an outlet device of Embodiment 5 of the present invention in water flowing state.
Figure 18:
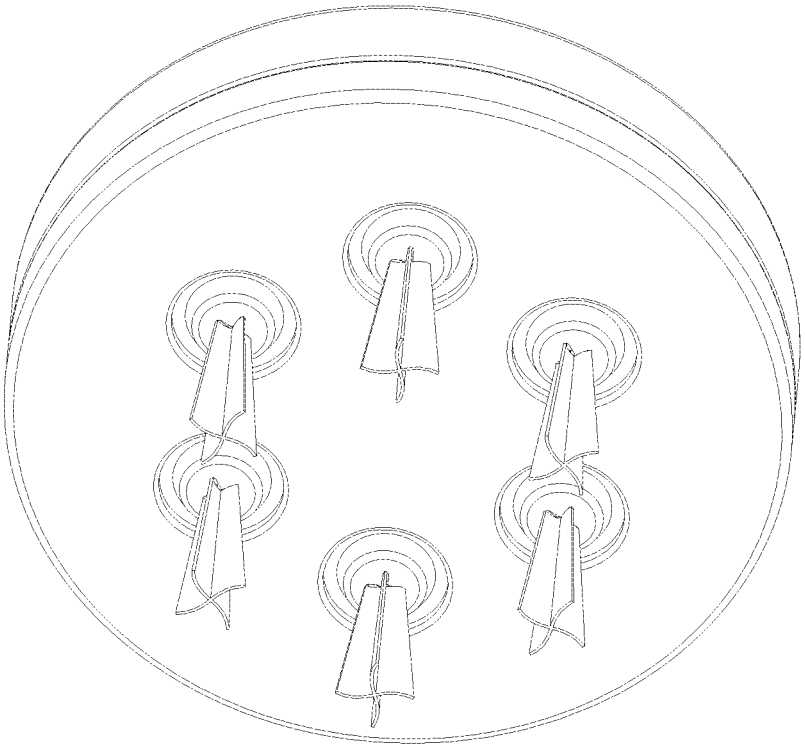
FIG. 18 illustrates a schematic diagram of the shower head of Embodiment 5 of the present invention in water flowing state.

Referring to FIGS. 16-18, this embodiment differs from Embodiment 1 in that: the section of the outlet 43 is cross-shaped by two orthogonal rounded rectangles.

Therefore, the water forms two orthogonal wavy fan-shaped water particles.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An outlet device providing vortex rotating water, comprising:

a diverter having a side surface disposed with at least two spiral accelerating grooves extending along an axial direction and having a bottom surface disposed with a collision chamber having a column shape and a side wall and being concaved in the axial direction, the at least two spiral accelerating grooves being evenly arranged about an axis of the collision chamber at the side surface of the diverter and having respective ends that extend to the bottom surface of the diverter to connect to the side wall of the collision chamber; and an outlet body disposed with an accommodating chamber and a vortex rotating chamber connected to each other in the axial direction, wherein the diverter is disposed in the accommodating chamber, wherein the vortex rotating chamber is a dome shaped body having a flat end face that is connected to a bottom end of the accommodating chamber and having an external protruding surface, wherein the outlet body has an end that is disposed with an outlet connected to the external protruding surface of the vortex rotating chamber, and wherein water flows through the at least two spiral grooves provided on the diverter, a part of the water flow enters the collision chamber and collision occurs, and another part of the water flow enters the vortex rotating chamber and flows along the inner wall of the vortex rotation chamber to form a vortex having a speed that is reduced due to division by the at least two spiral grooves.

2. The outlet device providing vortex rotating water according to claim 1, wherein the at least two spiral accelerating grooves have a helix angle θ that meets the requirement that 71°≤θ≤81°, and wherein the axis of the collision chamber of the diverter is disposed with a through hole connected to the top surface of the diverter.

3. The outlet device providing vortex rotating water according to claim 1, wherein the at least two spiral accelerating grooves have respective ends and are rotatably symmetrically arranged about the axis axes of the collision chamber.

4. The outlet device providing vortex rotating water according to claim 1, wherein the outlet has a cross section that is a rounded rectangle.

5. A shower head providing vortex rotating water, comprising:

a main body;

a cover plate;

a diverter having a side surface and a bottom; and an outlet body, wherein the cover plate is disposed with a plurality of through grooves in an axial direction for assembly thereof to the outlet body, wherein the side surface of the diverter is disposed with at least two spiral accelerating grooves extending along the axial direction and having respective ends, the bottom surface of the diverter is disposed with a collision chamber having a column shape, having a sidewall, and being concaved in the axial direction, the at least two spiral accelerating grooves being evenly arranged about the axis of the collision chamber at the side surface of the diverter, and respective ends of the at least two spiral accelerating grooves extend to the bottom surface of the diverter to connect to the side wall of the collision chamber, wherein the outlet body is disposed with an accommodating chamber and a vortex rotating chamber connected to each other in the axial direction, the diverter being disposed in the accommodating chamber, the vortex rotating chamber being a dome shaped body having a flat end face that is connected to a bottom end of the accommodating chamber and having an external protruding surface, and the outlet body having an end disposed with an outlet connected to the external protruding surface of the vortex rotating chamber, and wherein water flows through the at least two spiral grooves provided on the diverter, a part of the water flow enters the collision chamber and collision occurs, and another part of the water flow enters the vortex rotating chamber and flows along the inner wall of the vortex rotation chamber to form a vortex having a speed that is reduced due to division by the at least two spiral grooves.

6. The shower head providing vortex rotating water according to claim 5, wherein the at least two spiral accelerating grooves have a helix angle θ that meets the requirement that 71°≤θ≤81°, and wherein the axis of the collision chamber of the diverter is disposed with a through hole connected to the top surface of the diverter.

7. The shower head providing slow vortex rotating water according to claim 5, wherein the at least two spiral accelerating grooves have respective ends and are rotatably symmetrically arranged about the axis of the collision chamber.

8. The shower head providing vortex rotating water according to claim 5, wherein the outlet has a cross section that is a rounded rectangle.

9. The shower head providing vortex rotating water according to claim 5, wherein the accommodating chamber of the outlet body has an external side wall that is disposed with two protruding blocks vertically positioned with respect to the side wall of the accommodating chamber.

10. The shower head providing vortex rotating water according to claim 9, wherein the two protruding blocks have an intersection angle that is 180°, the plurality of through grooves of the cover plate includes four grooves that are coupled to the two protruding blocks, and the four grooves have an intersection angle that is 90°.

* * * * *